United States Patent [19]

Paulson

[11] Patent Number: 4,930,829

[45] Date of Patent: Jun. 5, 1990

[54] EMPTY CAN CARRIER

[76] Inventor: J. Rene Paulson, P.O. Box 334, Lachute, PQ J8H 3X5, Canada

[21] Appl. No.: 246,681

[22] Filed: Sep. 20, 1988

[51] Int. Cl.[5] ..... B65D 71/00

[52] U.S. Cl. ..... 294/87.2; 206/159; 206/162; 206/427; 206/493; 294/158; 294/159

[58] Field of Search ..... 294/27.1, 33, 87.1, 294/87.2, 87.28, 93, 137, 143, 145, 148, 158, 159, 160, 162, 165, 166, 170; 16/114 R; 206/139, 140, 142, 143, 145, 147–149, 151, 159, 162, 170, 175, 201, 427, 493; 211/71–74; 220/85 H, 94 R; 229/52 A, 52 BC

[56] References Cited

U.S. PATENT DOCUMENTS

| | | | |
|---|---|---|---|
| 1,039,619 | 9/1912 | Webb | 229/52 A |
| 2,401,664 | 6/1946 | Robins | 229/52 A |
| 2,405,914 | 8/1946 | Van Rosen | 229/52 A |
| 2,514,858 | 7/1950 | Gray | 294/87.2 |
| 2,645,406 | 7/1953 | Robins | 229/52 A |
| 2,646,911 | 7/1953 | Holmberg | 294/87.2 X |
| 2,711,873 | 6/1955 | Larin | 211/73 |
| 2,747,914 | 5/1956 | Lyons | 294/87.1 |
| 2,902,310 | 9/1959 | Berce | 294/33 |
| 3,016,136 | 1/1962 | Poupitch | 16/114 R X |
| 3,726,558 | 4/1973 | Klygis | 294/87.2 |
| 3,867,738 | 2/1975 | Garner | 294/27.1 |
| 4,111,298 | 9/1978 | Mascia et al. | 294/87.2 X |
| 4,236,638 | 12/1980 | Griffith | 294/87.2 X |
| 4,564,106 | 1/1986 | Shilcock | 294/87.2 X |
| 4,778,210 | 10/1988 | Paulson | 294/87.2 |

FOREIGN PATENT DOCUMENTS

| | | | |
|---|---|---|---|
| 688954 | 3/1953 | United Kingdom | 294/87.28 |

*Primary Examiner*—Johnny D. Cherry
*Attorney, Agent, or Firm*—Jones, Tullar & Cooper

[57] ABSTRACT

The invention relates to a carrier for empty beverage cans, particularly those that are returnable and recyclable. The carrier includes an elongated planar body with a plurality of spaced apart hooks where each hook has an elongated generally trapezoidal central section having converging side edges; a pair of elongated generally rectangular flap members; each attached to a respective side edge of the central section along a fold line; and a slit extending along each of the fold lines over a short distance from the inner end edge of the adjacent flap members. Each hook enters the opening of an empty can to engage the underside of the top plate of the can to suspend the can therefrom. By using the carrier, people returning cans have a convenient way of carrying the cans and the people receiving the cans are able to easily count the cans.

5 Claims, 4 Drawing Sheets

EMPTY CAN CARRIER

The present invention relates to a device for carrying empty cans, such as empty pop and/or beer cans, especially such cans that are returnable to a store for a refund. This application is related to co-pending U.S. patent application No. 07/100,263 filed Sept. 23, 1987 now U.S. Pat. No. 4,778,210 issued Oct. 18, 1988.

BACKGROUND OF THE INVENTION

The beverage industry has over the past ten or fifteen years increased drastically its use of thin-walled aluminum cans, particularly for soft drinks and beer. The use of such cans has prompted a hue and cry from environmentalists who have objected to the disposal of empty cans in the trash. As a consequence many states and provinces encourage the recycling of aluminum cans and promote such recycling by instituting a deposit/-refund program under which the purchaser pays a deposit of, say, five cents per can at the time of purchase and is entitled to a refund of the same amount when he returns the empty can. This program can create many headaches and problems at the locations where the cans are returned since, very often, they are returned by the bag-full and they must be counted and possibly sorted, a time consuming and thankless job.

There have been many inventions relating to carriers for cans; however most such inventions have been directed to the packaging or carrying of full cans. However, in Griffith U.S. Pat. No. 4,236,638 a carrier and storer for empty beverage cans is disclosed. The object of that invention is to provide a reusable carrier and storage device which will store a number of empty beverage cans and at the same time act as a carrier for returning cans.

SUMMARY OF THE INVENTION

The present invention addresses the problem of returnable "empties" by providing a carrier which is light in weight, is easy and inexpensive to manufacture, is adaptable for advertising purposes, and can be recyclable along with the cans carried thereby. Broadly speaking the carrier of this invention utilizes a planar body and a plurality of hook means carried by the planar body. Each hook means includes an elongated generally trapezoidal central section having converging side edges, a pair of elongated generally rectangular flap members, each attached to a respective side edge of the central section along a fold line, and slit means extending along each of the fold lines over a short distance from the inner end edge of the adjacent flap member.

Typically the planar body could be a thin, narrow strip of plastic or cardboard having a length approximately equal to the total of the diameters of the number of cans to be carried on each side. An appropriate number of hooks, say five, would be provided on each side of the strip and each hook would be engageable with the pour opening of a can, so that when the carrier was full there would be ten cans carried thereby. When the full carrier is brought to the can redemption center it is easily handled by all parties concerned; the can tops are readily viewable so that the receiver can quickly determine whether the cans are of the redeemable variety; and the refund calculation can be made almost automatically. By using the carrier of the present invention the task performed by all parties involved is made easier and since the inconvenience of returning cans would be diminished it is likely that more people could be inclined to return their cans rather than to relegate them to the trash.

The present invention will be described in greater detail hereinafter and with reference to the drawings attached hereto.

DESCRIPTION OF THE PREFERRED EMBODIMENT

Figure 1:
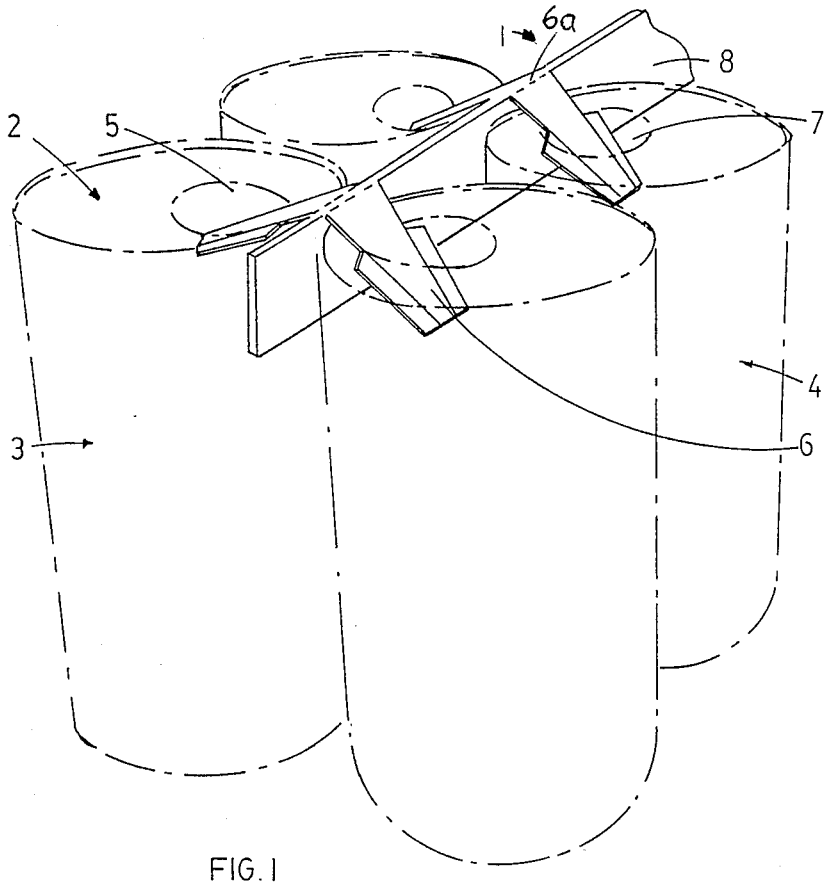
FIG. 1 illustrates in perspective view a first embodiment of the can carrier of this invention.

FIG. 1 of the drawings illustrates the empty can carrier device 1 of this invention in association with several empty cans 3, 4. The cans might be manufactured by different companies but each can has a pour opening in the top plate 2 thereof through which the beverage is removable. The pour opening may be circular like the opening 5, or it may be elliptical like the opening 7, depending on the manufacturer's design of the can. The pour openings 5, 7 provide a permanent access to the interior of the can. Typically the pour opening will have a maximum width of 1.5 to 2 cm.

The present invention makes use of the pour opening of an empty can by providing a means for engaging the can via the pour opening to hold the can in place.

Figure 2:
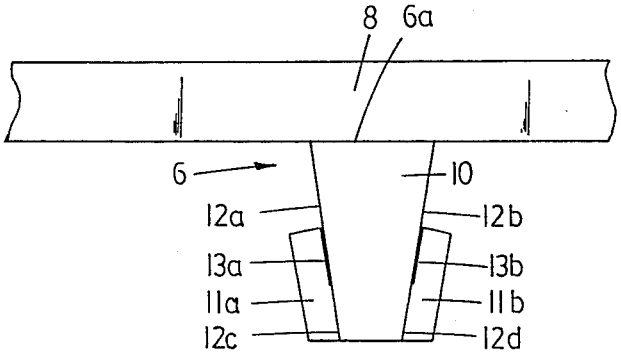
FIG. 2 illustrates in enlarged perspective a hook arrangement for use with the first embodiment.

With further reference to FIG. 2 the can carrier 1 of this invention includes an elongated planar body 8 and a plurality of hook means 6 spaced apart along the planar body, each being adapted for engaging the pour opening of a can.

The length of the elongated planar body 8 would depend on the number of cans that are to be carried. The length is approximately equal to the total of the diameters of the number of cans to be carried on one side of the carrying device. For example, five cans could be carried on each side which would mean that the length of the planar body would be approximately the total of the diameters of the five cans. Each of the ten cans (five on each side of the planar body) requires a hook means for attaching the can to the planar body.

FIG. 2 shows the hook means in greater detail. Each hook means 6 has an elongated trapezoidal central section 10 with converging side edges 12*a* and 12*b*. The hook means 6 is attached to the planar body 8 along a fold line 6*a* between the central section 10 and the body 8. On each of the converging side edges 12*a* and 12*b* a rectangular flap member 11*a* or 11*b* is attached along a fold line 12*c* or 12*d* with a slit 13*a* and 13*b* extending along the fold line 12*c* or 12*d* over a short distance from the inner end of the flap member.

To engage the empty can with the can carrier the hook means 6 is inserted through the pour opening 5 of the can 3 as shown in FIG. 1.

This is accomplished by firstly folding inwardly each flap member 11*a* and 11*b* along the fold line 12*c* and 12*d*, respectively, to make the hook means 6 small enough so that it can easily be inserted into the pour opening. During insertion the flap members 11*a* and 11*b* are released and they will open outwardly once inside the can. The can top plate 2 will then be captured between the planar body 8 and the inner end edges of the flap members 11*a* and 11*b*.

The material that is used to make the empty can carrier should preferably be of a disposable nature which adds to the usefulness of the carrier. The empty cans are returned along with the carrier. The empty can handler can easily rip apart the planar body 8, leaving each hook means 6 free to fall into the can.

Figure 3:
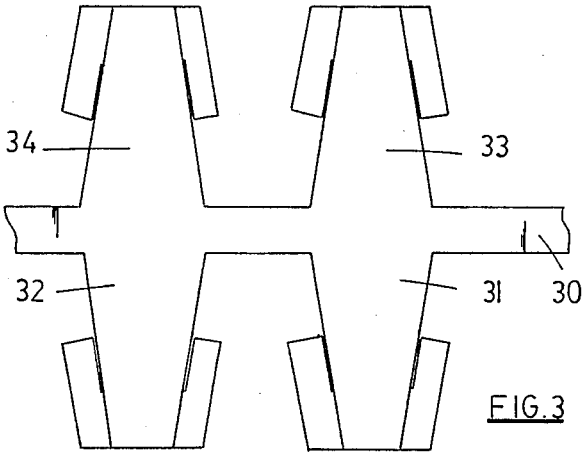
FIGS. 3 and 4 illustrate in perspective view additional embodiments of the can carrier of this invention.

The material that is used must also be such that it will be considered as an acceptable impurity by the recycler The device could thus be made of a plastic material or a cardboard material In the embodiment of FIG. 3 the planar body 30 has a plurality of hook means 31 to 34 extending therealong. Each hook means 31 to 34 is part of the planar body 30 and is formed from the same material The person carrying the cans can use the elongated planar body 30 as a handle to carry the device while holding the cans. This provides a lightweight, easy to carry and easily disposed device which will encourage the beverage can user to return the empty cans.

Figure 4:
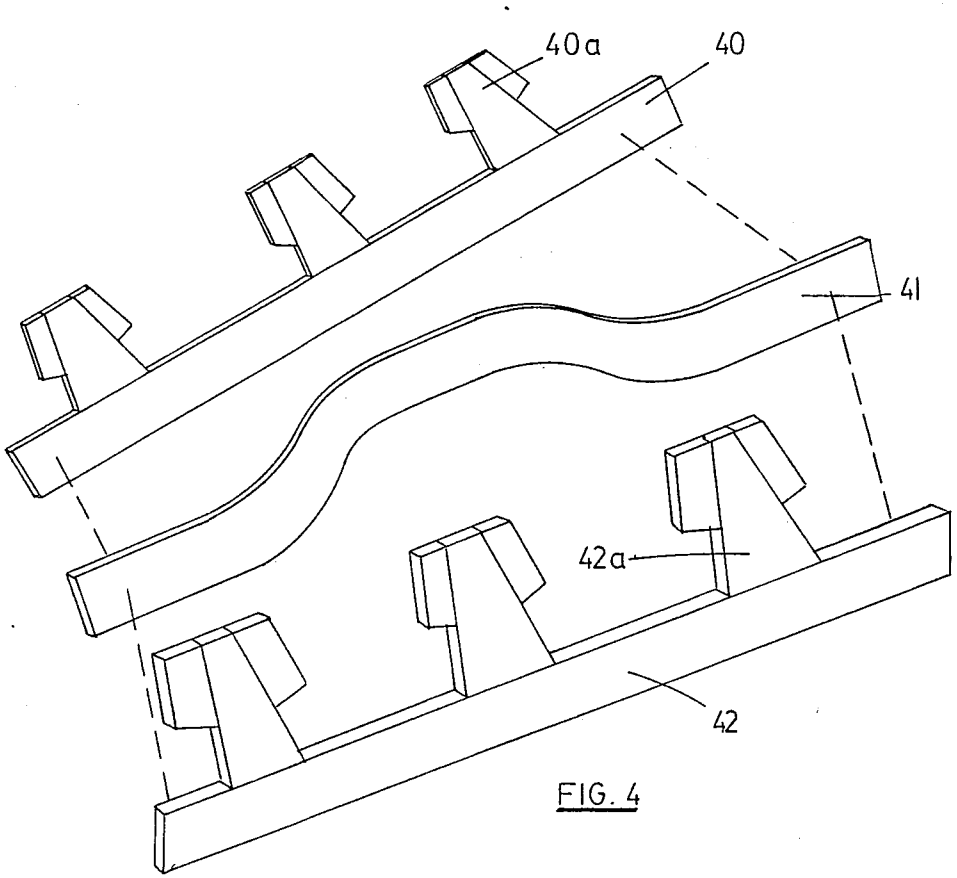

FIG. 4 shows another embodiment of the invention using an assembly of parts which includes a handle member 41 to facilitate carrying the device. The carrying device is comprised of a combination of the planar body 40 and the plurality of hook means 40A, the planar body 42 and the plurality of hook means 42A, and the elongated planar handle member 41. The two planar bodies 40 and 42 may be secured together with the handle member 41 sandwiched between them. Thus, the combination provides a carrying device carrying cans on either side of the handle member 41. The number of hook means 42A and 40A is preferably the same and the number of hook means can be decided by the manufacturer. For the sake of an example, let there be five hook means 40A on planar body 40 and let there be five hook means 42A on planar body 42; hence, the carrying device will be able to hold ten empty cans allowing for easy returning of the cans. The empty can handler can pull in opposite directions on the handle member 41 and the can in order to rip the can away from the carrying device. The material of the planar bodies 40 and 42, the hook means 40A and 42A, and the handle member 41 should be of a disposable nature for convenience sake. The disposable material could be cardboard or plastic in nature.

METHOD OF MANUFACTURE

Figure 5:
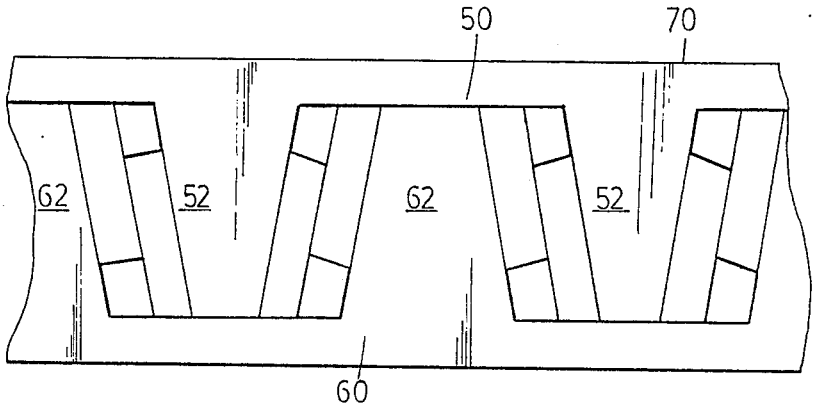
FIGS. 5 and 6 show how the parts of FIG. 4 could be punched out from a sheet of cardboard.
Figure 6:
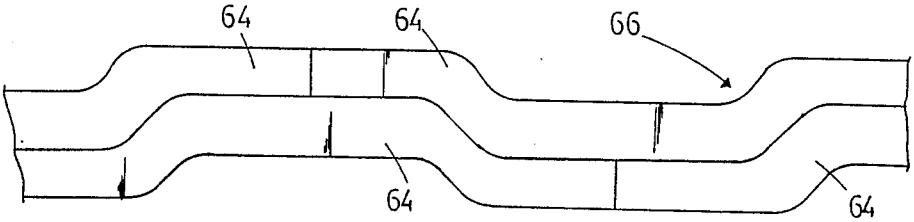

The carrier can be manufactured at a low cost. The recyclable material that is chosen can be fed through a machine that can cut the material in the required shapes described hereinabove. As shown in FIG. 5, two planar bodies 50 and 60 and two hook means 52 and 62 can be cut out from an elongated 70 strip of material such as cardboard. As the strip 70 passes through the machine, the outline of the planar body and the hook means is die cut from the strip and the various fold lines are scored in the material. By interdigitating the hook means as shown, it is possible to keep wastage to an absolute minimum. The length of the strip is left to the manufacturer since the number of hook means in each carrying device is decided by them. In the embodiment of the invention using a handle member, the manufacturers can also interweave two handle members 64 die cut from a strip of material 66 as seen in FIG. 6.

The embodiments of the invention in which an exclusive property or privilege is claimed are defined as follows:

1. A device for carrying empty beverage cans that have an opening in a top plate thereof comprising:

an elongated planar body, and a plurality of hook means attached to said planar body wherein, each hook means includes an elongated, generally trapezoidal central section having converging side edges, a pair of elongated generally rectangular flap members, each attached to a respective side edge of said central section along a fold line, and slit means extending along each said fold line over a short distance from an inner end edge of the adjacent flap member;

whereby said flap members of each hook means are foldable inwardly along said fold lines to facilitate insertion of said hook means into a can through the opening thereof, and following insertion said flap members will open outwardly to capture said can top plate on the hook means between said planar body and the inner end edges of the flap members.

2. The device of claim 1 wherein the carrying device comprises a combination of a pair of said elongated planar bodies each having a plurality of said hook means thereon and an elongated planar handle member sandwiched between and secured to said planar bodies.

3. The device of claim 2 wherein each hook means is attached to the adjacent planar body along a fold line between the central section of the hook means and the planar body.

4. The device of claim 1 wherein said hook means and said planar body are integrally formed of a plastics material.

5. The device of claim 1 wherein said hook means and said planar body are integrally formed of a cardboard material.

* * * * *